US005190090A

United States Patent [19]

Mraz-Wasch

[11] Patent Number: 5,190,090

[45] Date of Patent: Mar. 2, 1993

[54] TOY DOOR ASSEMBLY

[76] Inventor: Denise Mraz-Wasch, 9241 Highland Dr., Brecksville, Ohio 44144

[21] Appl. No.: 717,088

[22] Filed: Jun. 18, 1991

[51] Int. Cl.[5] ..... E06B 7/28

[52] U.S. Cl. ..... 160/180; 160/116

[58] Field of Search ..... 160/180, 181, 182, 183, 160/127, 128, 135, 327, 351, 352, 368.1, DIG. 8, 116; 272/22; 446/109, 110, 478, 487; 472/77

[56] References Cited

U.S. PATENT DOCUMENTS

| | | | |
|---|---|---|---|
| 1,315,628 | 9/1919 | Gilbert | 160/127 |
| 1,647,733 | 11/1927 | Keichline | 160/127 |
| 3,247,628 | 4/1966 | Miller | 446/478 X |
| 3,562,973 | 2/1971 | Gangemi | 160/135 |
| 3,601,916 | 8/1971 | Epstein | 160/135 X |
| 3,913,656 | 10/1975 | Guyer | 160/135 |
| 3,916,838 | 11/1975 | Swart . | |
| 4,011,682 | 3/1977 | Ach | 160/135 X |
| 4,372,364 | 2/1983 | Katz . | |
| 4,764,142 | 8/1988 | Griffith et al. | 272/22 X |
| 4,914,844 | 4/1990 | Seery . | |

*Primary Examiner*—David M. Purol
*Attorney, Agent, or Firm*—Raymond J. Slattery

[57] ABSTRACT

A toy door assembly for covering a portal comprises a panel member, a door member, a doorway defined within the panel member, a hinge connecting the door member to the panel member for opening and closing the doorway, and support structure integral with the panel member for supporting the panel member when in use. The panel member comprises a central panel portion, opposite sides extending generally upwardly when the assembly is in use, a top side and a bottom side. The support structure comprises a support tab connected to one of the panel member sides and extends from the side into proximity with a peripheral region of the portal. The preferred support structure further comprises anchor structure for securing the support tab to the peripheral region. The anchor structure is formed by cooperating hook and loop structures which enable adhesion of the panel about the portal. The support tab is connected to the panel member by scoring the panel material along the juncture of the support tab and the corresponding panel member side. The hinge is formed by scoring the panel material along the juncture of the door member and panel member to facilitate bending and then reinforcing the scored bend line with tape adhered to the panel.

20 Claims, 5 Drawing Sheets

TOY DOOR ASSEMBLY

TECHNICAL FIELD

This invention relates to toys, and more specifically to toy door assemblies detachably covering portals, or doorways, in buildings.

BACKGROUND

Small scale "playhouses," furniture and appliances constructed on a child's scale are in widespread use in playrooms and bedrooms by children at play. Playrooms and bedrooms are accessible through adult sized portals or doorways which are not only out of scale compared to children's furnishings but also, when they remain open, may preclude a sense of seclusion or privacy during play.

The present invention provides a new and improved children's toy door assembly wherein a toy door is provided in a panel which detachably covers a building wall portal so that children can pass through the portal via the toy door with the portal being closable by closing the toy door.

SUMMARY OF THE INVENTION

In a preferred and illustrated embodiment of the invention a toy door assembly for covering a portal is provided which comprises a panel member, a doorway defined within the panel member, a door member, a hinge connecting the door member to the panel member for opening and closing the doorway, and support structure integral with the panel member for supporting the panel member when in use.

The preferred support structure comprises a support tab connected to a panel member side and extending from the side into proximity with a peripheral region of the portal. The support tab is hinged to the panel member along a bend line and has a folded position where it stiffens the erected assembly.

The preferred support structure further comprises anchor structure for securing the assembly to the peripheral portal region. The preferred anchor structure is formed with cooperating hook and loop fastener elements which enable adhesion of the panel about the portal.

The preferred hinge is formed by scoring the panel material along the juncture of the door member and panel member to facilitate bending and then reinforcing the scored bend line with tape adhered to the panel.

Other features and advantages of the invention will become apparent from the following description of a preferred embodiment made with reference to the accompanying drawings.

BEST MODE FOR PRACTICING THE INVENTION

Figure 1:
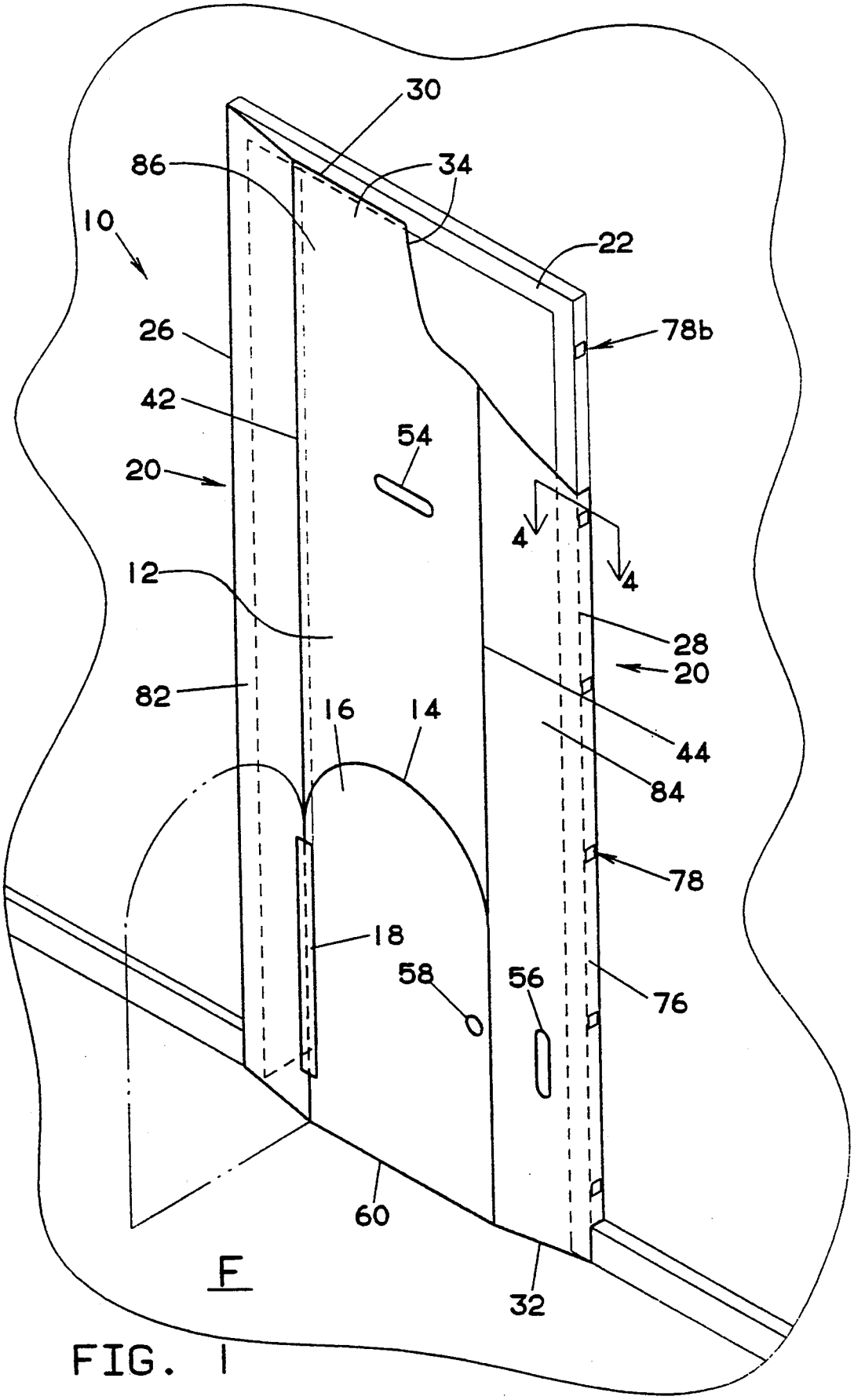
FIG. 1 is a perspective, fragmentary view of a child's door assembly constructed according to the invention detachably mounted on a door frame.

A toy door assembly 10 for detachably covering a portal or doorway of a child's playroom is illustrated in the drawings. The assembly 10 comprises a panel member 12, a doorway 14 defined within the panel member, a door member 16, a hinge 18 connecting the door member 16 to the panel member 12, and support structure 20 integral the panel member for supporting the door assembly when in use. In the illustrated embodiment, the door assembly 10 is detachably positioned to cover a door frame molding 22 extending about a portal between rooms in a building. The illustrated assembly 10 is made from a relatively thick, high strength sheet of "cardboard" material which is cut, scored and creased appropriately to produce elements of the assembly.

The preferred panel member 12 is generally rectangular and sized to provide a greater frontal area than the door frame molding 22 so that when the assembly 10 is in place the door molding 22 is covered. The panel member 12 comprises opposite upwardly extending sides 26, 28, a top side 30 extending along the top of the door frame 22 and a bottom side 32 adjacent the floor. The panel member 12 defines opposite major surfaces 34, one facing through the portal and the other away from the portal. The major surfaces preferably bear printed indicia which can be illustrations of popular cartoon figures, etc. familiar to children. Alternatively, the surfaces 34 can be finished with an easily erasable plain coating to enable the user to illustrate the surfaces as desired.

The panel member is constructed so that it is easily folded into a compact package for shipment or storage. Fold lines 40, 42, 44 are formed in the panel member so that the assembly can be folded roughly in thirds and then in half. The fold line 40 extends horizontally across the panel member just above the doorway 14 when the assembly 10 is erected. The fold lines 42, 44 extend vertically parallel to each other in alignment with opposite sides of the doorway 14. The fold lines 40, 42, 44 are preferably formed in part by scoring the panel member. This procedure makes it easy to fold the panel member without unduly weakening it.

The doorway 14 is formed in the panel member 12 by a cut line 50 and a series of score lines 52. The cut line 50 defines a straight, upwardly extending side of the doorway (aligned with the fold line 42) and a contiguous arch section at the upper end. The arch section merges into the score lines 52 which are aligned to form the opposite doorway side. The doorway 14 is dimensioned to accommodate children between 3 and 9 years old and thus is relatively small compared to the door frame molding 22. The height of the doorway 14 is less than half that of the panel to minimize the folded size of the assembly 10.

In the illustrated assembly 10 a viewing port 54 and simulated mail slot 56 are formed in the panel member. The viewing port 54 is illustrated as an elongated narrow slot formed above the doorway 14 to enable easy observation through the panel by adult sized persons. The simulated mail slot 56 is disposed beside the doorway 14.

The door member 16 is formed by the cut and score lines 50, 52 which define the doorway 14. Thus the door member has an arched top and a straight side formed by the cut line 50 and is connected to the panel 12 along the score lines 52. A simulated keyhole 58 cut through the door provides a hand hold for gripping the door when being opened or closed. In the preferred assembly 10 the door member bottom side 60 is cut short of the panel member bottom side 32 to provide clearance for carpeting, area rugs or other floor surface covering between the door member and the floor F.

The hinge 18 can be of any suitable construction, but in the illustrated assembly 10 comprises a series of panel material bridges 62 extending between the panel member 12 and the door member 16 bridging the panel and door member juncture. The bridges 62 are defined by and between the spaced score lines 52. The door member opens and closes by flexing and bending the bridges 62 along a hinge line which is aligned with the panel fold line 44. The score lines 52 serve to reduce the resistance to motion the panel members material would otherwise exhibit, yet do not significantly weaken the connection between the door and panel members.

In the preferred and illustrated embodiment, the hinge 18 further comprises a length of tape 64 covering the score lines 52 and the bridges 62. The tape 62 is formed from fabric or plastic ribbon with an adhesive material on one side. The tape provides added strength and support when the door member 16 is opened and closed yet is readily flexible so door opening and closing is easy. The tape can be of any appropriate construction and may be placed on both major surfaces 34, if desired.

The support structure 20 maintains the assembly 10 in its erected condition when in use. In the preferred assembly 10, the support structure comprises support tabs 74, 76 and anchors 78. The support tabs 74, 76 are respectively connected to the opposite panel member sides 26, 28. The illustrated tabs 74, 76 are continuous with the panel members and hinged to the panel member sides 26, 28 by bend lines (which define the sides 26, 28). The illustrated assembly employs bend lines which are intermittently scored to facilitate movement of each tab about an axis defined by its associated bend line.

The tabs 74, 76 extend from adjacent the top side of the erected assembly 20 across the horizontal fold line to adjacent the bottom side 32 where they are cut away to provide clearance for a baseboard adjacent the door frame molding 22 when the door assembly 10 is erected. When bent to their positions illustrated in FIG. 1, tabs 74, 76 extend across the line of the fold line 40 and serve to stiffen and stabilize the assembly 10 when it is erected. The fold line 40 could otherwise allow the door assembly 10 to buckle or fold in half when the assembly is erected.

The anchors 78 detachably secure the assembly 10 to the door frame molding 22. The illustrated anchors 78 secure the support tabs 74, 76 to the door frame mold when the tabs are folded into position. Thus, the illustrated anchors not only serve to maintain the assembly 10 in its erect position but also maintain the tabs in their folded conditions. The preferred anchors are formed by cooperating pairs of hook and loop fastener elements **78*a*, 78*b*** attached to the tabs and the door frame molding, respectively. Each fastener element comprises a circular flexible body having hook or loop filaments fixed to one side and projecting away from the body. The other side of the body is provided with a pressure adhesive by which it is adhered to its associated tab or to the door frame molding. The bodies can be peeled off the molding and tab and later replaced, if desired. The fastener elements are of the type which may be purchased under the trademark Velcro TM.

In the illustrated assembly, several fastener elements **78*a* are attached to each tab at spaced-apart locations along the length of the tab. An equal number of fastener elements 78*b* is adhered to each side of the door frame molding at spaced locations which are aligned with elements 78*a* when the assembly is erected. The aligned elements 78*a*, 78*b* are pressed together when the assembly is erected and "latch" the tabs 74, 76** to the door frame molding sides.

In the preferred assembly, the support structure 20 further comprises panel member portions which are positioned to further stiffen the assembly 10 when it is erected.

Figure 2:
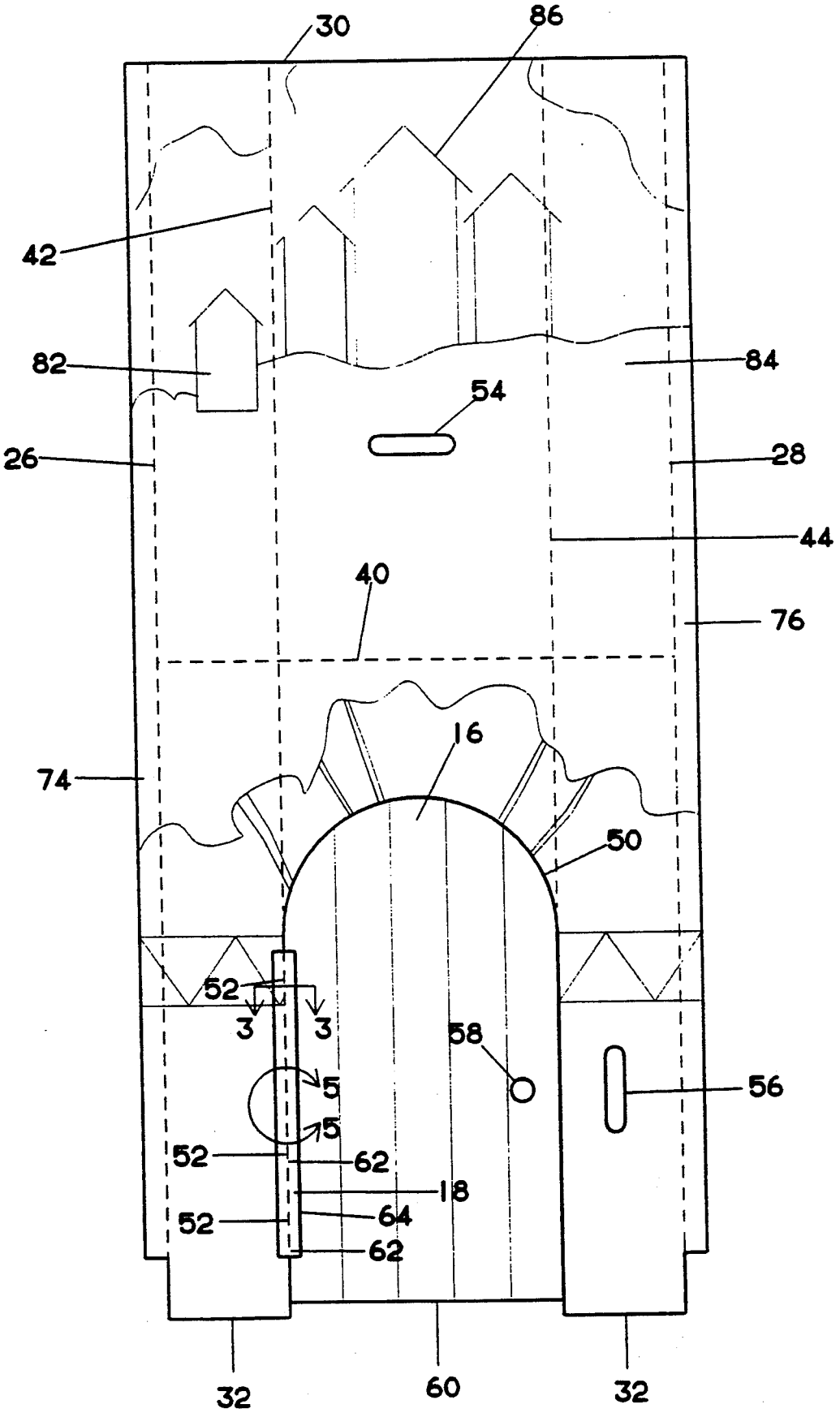
FIG. 2 is an elevational view of the child's door assembly of FIG. 1.
Figure 3:
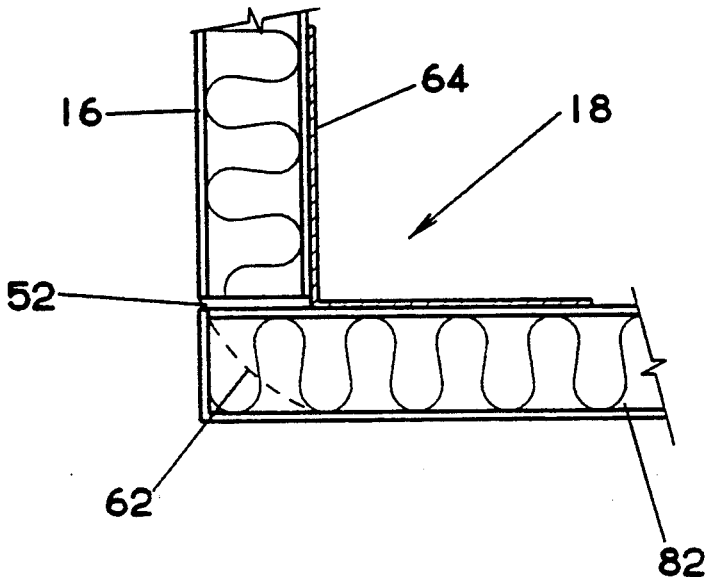
FIG. 3 is an enlarged fragmentary view of a toy door hinge as seen from the plane indicated by the line 3—3 of FIG. 2 with parts in an alternative position.
Figure 4:
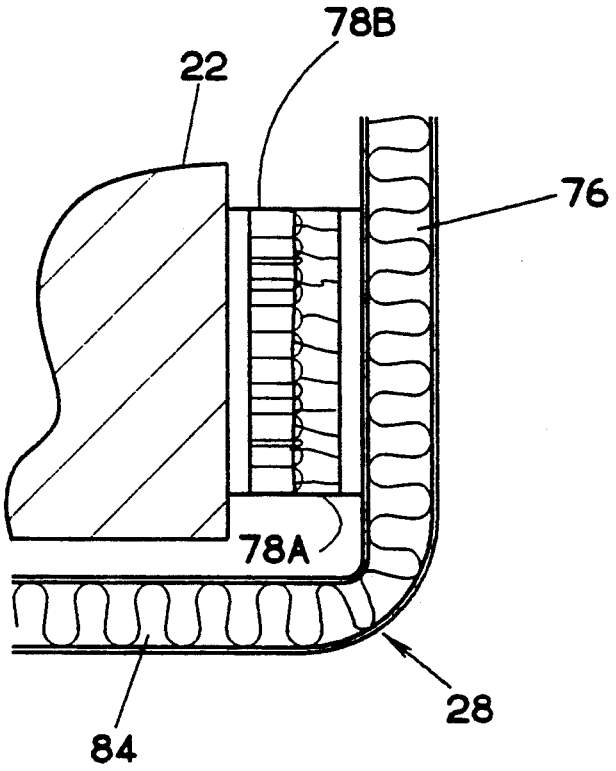
FIG. 4 is an enlarged fragmentary cross sectional view seen approximately from the plane indicated by the line 4—4 of FIG. 1; and, FIG. 5 is an enlarged fragmentary view of part of the toy door assembly within the line 5 of FIG. 2.
Figure 5:
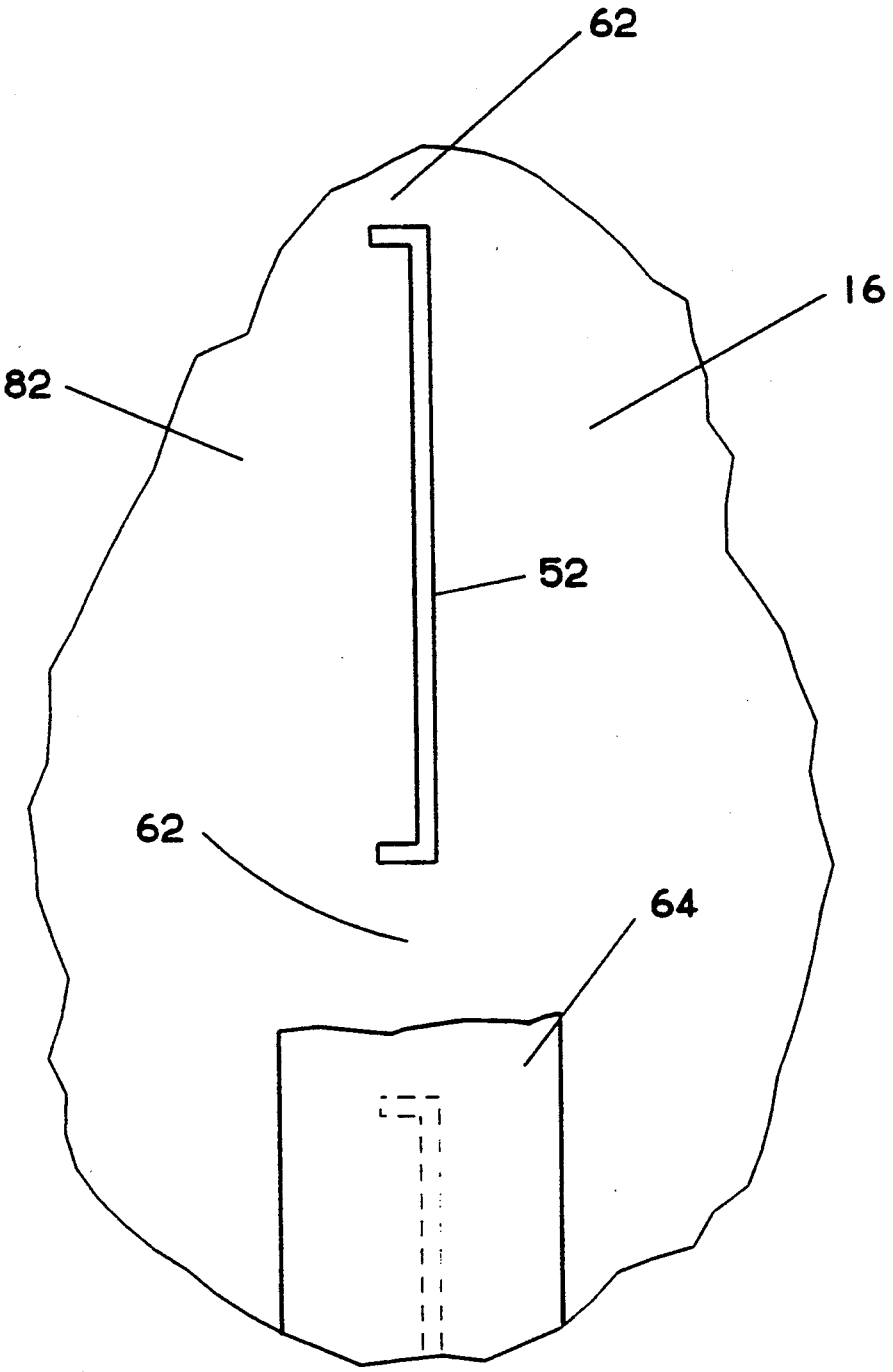

As illustrated by FIGS. 1 and 2 the panel member 12 comprises a first, central panel portion 82 defined between the fold lines 42, 44 and second, flanking panel portions 84, 86 defined between the respective fold lines and panel member sides 26, 28. The doorway 14 and door member 16 are defined within the central panel portion 82. The second panel portions extend parallel to each other across the horizontal fold line 40. The illustrated assembly 10 (FIG. 1) is erected with the second panel portions folded along the respective lines 42, 44 to form obtuse angles with respect to the central portion 82 and the respective associated support tab. The folded second portions coact with the support tabs to further stiffen the erected assembly against any tendency to fold about the line 40. The erected assembly 10 resembles a "bay window" because the second portions extend at slight angles with respect to the central portion.

The "bay window" form of construction further enables the assembly 10 to fit portals and door frame moldings having various widths. The second panel portions can be bent at varying obtuse angles with respect to the central portion to align the support tabs with the sides of particular door frame moldings while stiffening the assembly 10.

While a single preferred embodiment of the invention has been illustrated and described in detail the invention is not to be considered limited to the precise construction disclosed. Various adaptations, modifications and uses of the invention may occur to those skilled in the art to which the invention relates. For example, a support tab could be connected to the top side of the panel member in addition to or in lieu of the support tabs 74, 76; or support feet could be connected to the bottom side of the panel member. The intention is to cover all such adaptations, modifications and uses which fall within the scope or spirit of the appended claims.

Having described my invention, I claim:

1. A toy door assembly for covering a portal comprising:

a. a panel member comprising opposite sides extending generally upwardly when said assembly is in use, a top side and a bottom side which extend generally horizontally when said assembly is in use and said panel member defining a doorway therein;

b. a door member;

c. a hinge connecting said door member to said panel member for opening and closing the doorway;

d. support structure integral with said panel member for supporting said door assembly and for detachably securing the assembly to a peripheral portal region when in use;

wherein said panel member comprises a first panel portion defining said doorway and said support structure further comprises a second panel portion between said first panel portion and one of said upwardly extending sides, said second panel portion disposed at an angle with respect to said first panel portion to stiffen said assembly when in use; and wherein said first panel portion comprises a first fold line extending parallel to said top and bottom sides, said panel member foldable along said first fold line into a storage configuration, said second panel portion foldable along a second fold line extending transversely with respect to said first fold line into the storage configuration.

2. The door assembly of claim 1 wherein the support structure comprises a support tab connected to one of said panel member sides and extending from said side into proximity with a peripheral region of said portal, said support tab extending at an angle from said side for stiffening said assembly when in use.

3. The door assembly of claim 2 wherein said support tab is disposed along one of said upwardly extending panel member sides and said support structure further comprises a second tab located along the opposite upwardly extending panel side.

4. The door assembly of claim 3 wherein said tabs are hinged on said upwardly extending sides to allow said tabs to be bent and flexed and disposed out of the plane of said panel member to stiffen said door assembly.

5. The door assembly of claim 4 wherein said support structure further comprises anchor means for detachably engaging said peripheral region, portal region and said assembly.

6. The door assembly of claim 2 wherein said panel member comprises a first panel portion defining said doorway and said support structure further comprises a second panel portion between said first panel portion and one of said upwardly extending sides, said second panel portion disposed at an angle with respect to said first panel portion to stiffen said assembly when in use.

7. The door assembly of claim 1 wherein said support structure further comprises anchor means for detachably connecting said assembly to a peripheral region of a portal.

8. The door assembly claimed in claim 7 wherein said anchor means comprises cooperating hook and loop fastener elements adhered to said peripheral region and to said assembly, said respective elements aligned and latched together when said assembly is in use.

9. The door assembly of claim 1 wherein said hinge comprises tape extending between said door member and said panel member adjacent said doorway.

10. The door assembly of claim 1 wherein said panel member and said door member are formed from the same material and are continuous, said hinge comprising bridges of said material extending between said door member and said panel member.

11. The door assembly of claim 1 wherein said door assembly further comprises opposite major panel member faces, said faces defining indicia bearing surfaces.

12. A toy door assembly for covering a portal comprising:

a. a panel member formed from a sheet of material comprising opposite sides extending generally upwardly when said assembly is in use, a top side and a bottom side which extend generally horizontally when said assembly is in use;

b. a small scale doorway defined within said panel member;

c. structure for enabling said assembly to be folded to a storage condition comprising a first fold line extending across said panel member generally parallel to said top and bottom side, said panel member foldable along said first fold line into said storage condition, and second fold lines extending transversely with respect to said first fold line, said panel member foldable along said second fold lines to said storage condition; and, e. support structure integral with said panel member for supporting said door assembly when in use, said support structure comprising a panel member portion between one of said second fold lines and the adjacent upwardly extending panel side, said panel portion bent about said one fold line when said assembly is in use to stiffen said assembly against folding about said first fold line.

13. A toy door assembly for covering a portal comprising:

a. a panel member comprising opposite sides extending generally upwardly when said assembly is in use, a top side and a bottom side which extend generally horizontally when said assembly is in use and said panel member defining a doorway therein;

b. a door member;

c. a hinge connecting said door member to said panel member for opening and closing the doorway;

d. support structure integral with said panel member for supporting said door assembly and for detachably securing the assembly to a peripheral portal region when in use; and wherein said first panel portion comprises a first fold line extending parallel to said top and bottom sides, said panel member foldable along said first fold line into a torage configuration, said second panel portion foldable along a second fold line extending transversely with respect to said first fold line into the storage configuration.

14. The door assembly of claim 13 wherein the support structure comprises a support tap connected to one of said panel member sides and extending from said side into proximity with a peripheral region of said portal, said support tab extending at an angle from said side for stiffening said assembly when is use.

15. The door assembly of claim 14 wherein said support tap is disposed along one of said upwardly extending panel member sides and said support structure further comprises a second tab located along the opposite upwardly extending panel side; and wherein said tabs are hinged on said upwardly extending sides to allow said tabs to be bent and flexed and disposed out of the plane of said panel member to stiffen said door assembly.

16. The door assembly of claim 15 wherein said support structure further comprises anchor means for detachably engaging said peripheral region, portal region and said assembly.

17. The door assembly of claim 13 wherein said support structure further comprises anchor means for detachably connecting said assembly to a peripheral region of a portal.

18. The door assembly claimed in claim 17 wherein said anchor means comprises cooperating hook and loop fastener elements adhered to said peripheral region and to said assembly, said respective elements aligned and latched together when said assembly is in use.

19. The door assembly of claim 14 wherein said panel member comprises a first panel portion defining said doorway and said support structure further comprises a second panel portion between said first panel portion and one of said upwardly extending sides, said second panel portion disposed at an angle with respect to said first panel portion to stiffen said assembly when in use.

20. The door assembly of claim 13 wherein said panel member and said door member are formed from the same material and are continuous, said hinge comprising bridges of said material extending between said door member and said panel member.

* * * * *